US007318749B2

(12) United States Patent
Li et al.

(10) Patent No.: US 7,318,749 B2
(45) Date of Patent: Jan. 15, 2008

(54) POWER CONNECTOR WITH IMPROVED CONTACTS

(75) Inventors: Xiao-Li Li, Kunshan (CN); Wei-Ya Cheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,703

(22) Filed: Dec. 30, 2005

(65) Prior Publication Data

US 2006/0258212 A1 Nov. 16, 2006

(30) Foreign Application Priority Data

May 10, 2005 (CN) ..... 2005 2 0071603 U

(51) Int. Cl.
*H01R 9/05* (2006.01)

(52) U.S. Cl. ..... 439/580

(58) Field of Classification Search ..... 439/580, 439/63, 80, 581, 79, 550, 551
See application file for complete search history.

(56) References Cited

U.S. PATENT DOCUMENTS

| | | | | |
|---|---|---|---|---|
| 2,942,074 | A * | 6/1960 | Gloviak et al. | 200/51.1 |
| 3,293,592 | A * | 12/1966 | Blonder | 439/581 |
| 3,418,438 | A * | 12/1968 | Barrett | 200/51.1 |
| 3,858,156 | A * | 12/1974 | Zarro | 439/221 |
| 4,725,239 | A * | 2/1988 | Shichida | 439/29 |
| 4,899,252 | A * | 2/1990 | Birzer | 361/627 |
| 5,531,606 | A * | 7/1996 | Rodrigues et al. | 439/188 |
| 5,547,400 | A * | 8/1996 | Wright | 439/668 |
| 5,759,069 | A * | 6/1998 | Kitatani et al. | 439/675 |
| 6,589,075 | B1 * | 7/2003 | Wu | 439/550 |
| 6,623,277 | B1 * | 9/2003 | Zhu et al. | 439/63 |
| 6,659,784 | B1 * | 12/2003 | Klein et al. | 439/188 |
| 6,676,443 | B1 * | 1/2004 | Wang | 439/541.5 |
| 6,695,644 | B2 * | 2/2004 | Zhao et al. | 439/580 |
| 6,786,752 | B1 * | 9/2004 | Kerekes et al. | 439/339 |
| 6,875,048 | B2 | 4/2005 | Lee | |
| 6,932,614 | B1 * | 8/2005 | Kan | 439/580 |
| 6,948,977 | B1 * | 9/2005 | Behrent | 439/581 |
| 6,971,774 | B2 * | 12/2005 | Wu | 362/430 |
| 2004/0009702 | A1 * | 1/2004 | Potega | 439/578 |
| 2004/0014358 | A1 * | 1/2004 | Leve | 439/581 |
| 2004/0033721 | A1 * | 2/2004 | Pocrass | 439/578 |
| 2005/0255720 | A1 * | 11/2005 | Geil et al. | 439/63 |

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

A power connector (1) is connectable with a cable having a number of conductors and matable with a complementary connector for power transmission. The power connector includes an insulative housing (2) defining a receiving cavity (210), at least one contact (3, 4) capable of power transmission. The at least one contact received in the housing and includes a contacting portion (31, 41) exposed to the receiving cavity and a tail portion (32, 42) extending beyond the housing. The tail portion is composed of two separated connecting areas (320, 420) respectively connectable with corresponding conductors of the cable.

13 Claims, 6 Drawing Sheets

POWER CONNECTOR WITH IMPROVED CONTACTS

BACKGROUND OF THE INVENTION

1. Field of the Invention

The present invention relates to an electrical connector, particularly to a power connector transmitting power signal.

2. Description of Related Art

Power connectors are widely used in the electrical industry to connect power supplies with electrical devices, such as mobile phone, note book. The power connector commonly comprises a dielectric housing, a first contact and a second contact respectively served as a positive pole and a negative pole of a power supply for providing voltage to electrical device connecting to the power connector, and a signal contact provided for signal transmission. When the power supply and the electrical device are spaced apart, the power connector has to connect with a cable to form a power connector assembly connecting with the electrical device and the power supply. The first, second and signal contacts of the power connector generally are soldered to conductors of a cable. However, it is possible that the connection of the contacts and the conductors is unstable or broken because of some drawbacks during soldering process, such as void solder, false solder etc. besides, since the user is used to draw the power connector from the electrical device by directly pulling the cable connected with the power connector, the soldering connection of the contacts and the conductors is prone to be damaged due to unwanted exterior force.

Hence, an improved power connector is desired to overcome the disadvantages of the related art.

SUMMARY OF THE INVENTION

Accordingly, an object of the present invention is to provide a power connector comprising contact, which is capable of power transmission and reliably electrically connects with corresponding conductor of a cable.

In order to achieve the object set forth, a power connector in accordance with the present invention is connectable with a cable having a plurality of conductors and matable with a complementary connector for power transmission. The power connector comprises an insulative housing defining a receiving cavity, at least one contact capable of power transmission. The at least one contact received in the housing and comprises a contacting portion exposed to the receiving cavity and a tail portion extending beyond the housing. The tail portion is composed of two separated soldering areas respectively solderable with corresponding conductors of the cable.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
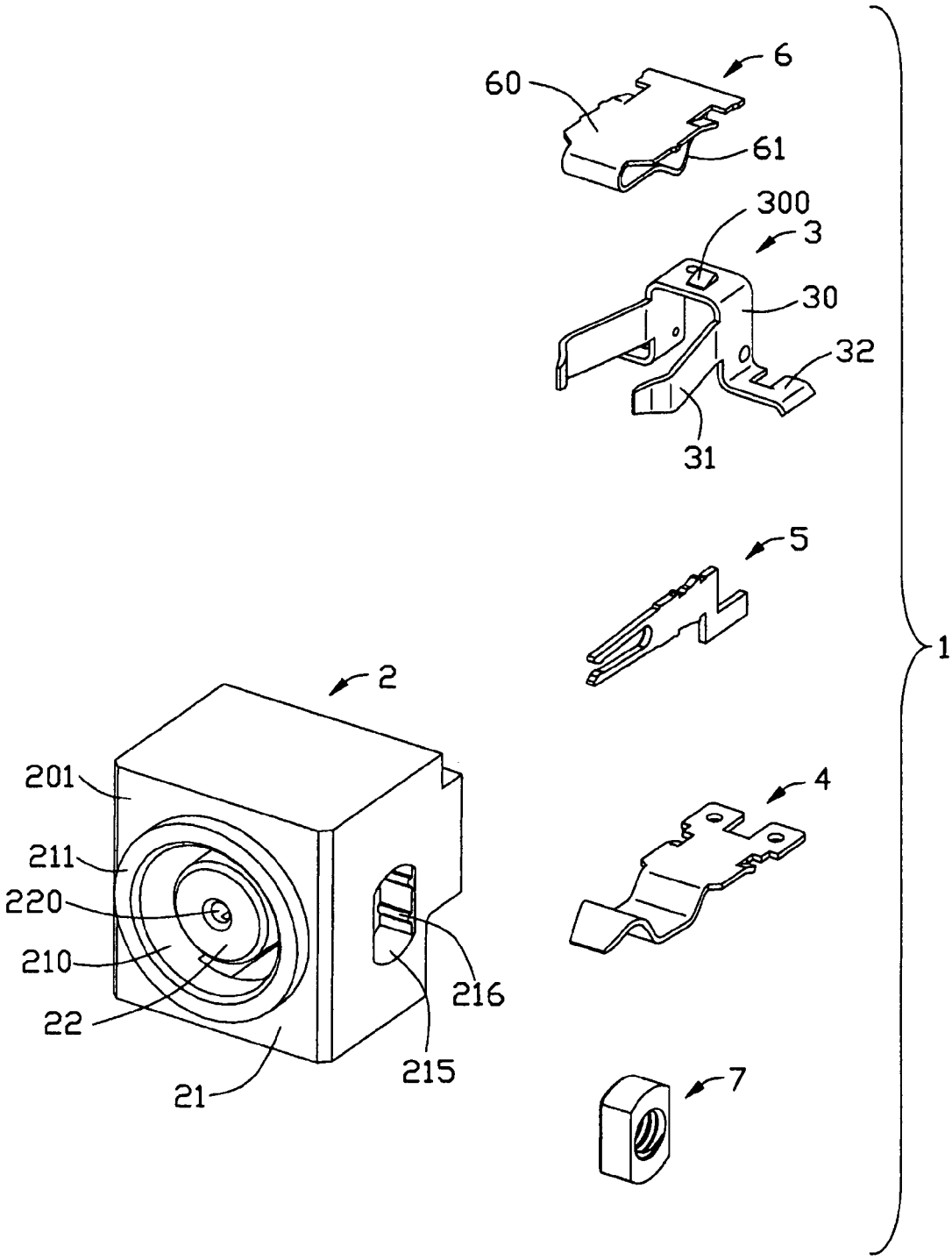
FIG. 1 is an exploded, perspective view of a power connector in accordance with the present invention.
Figure 2:
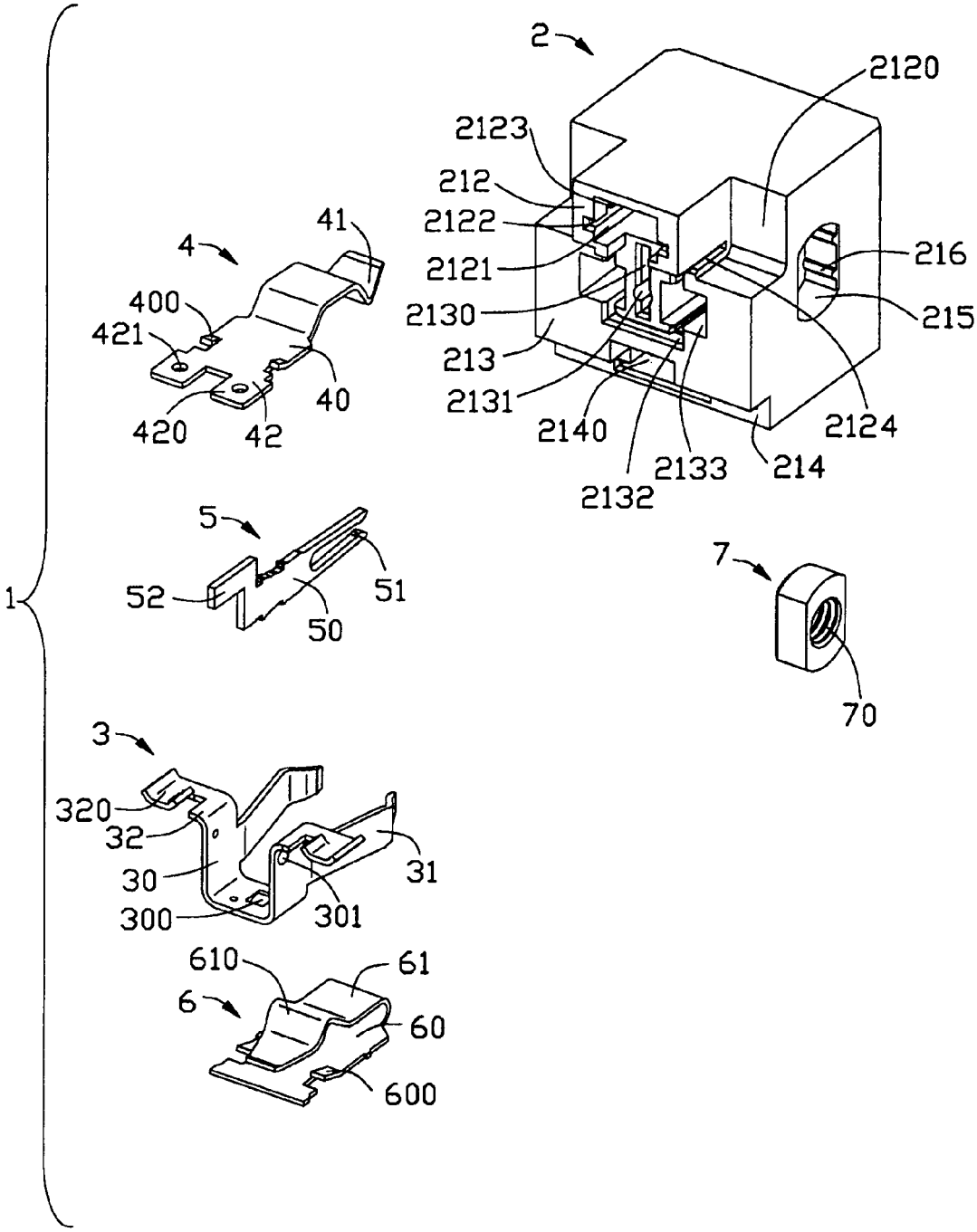
FIG. 2 is a view similar to FIG. 1, but viewed from another aspect.
Figure 3:
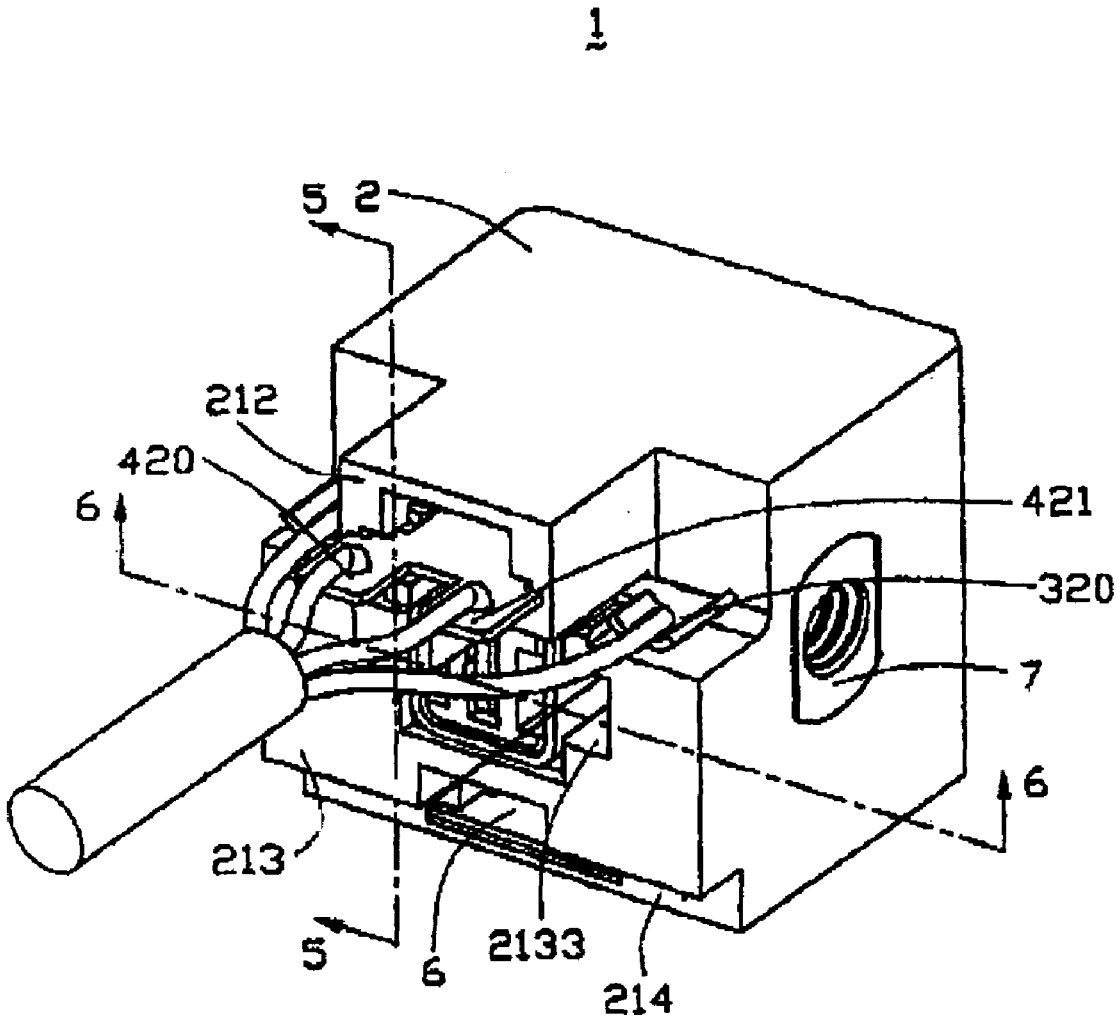
FIG. 3 is an assembled, perspective view of the power connector shown in FIG. 2.
Figure 4:
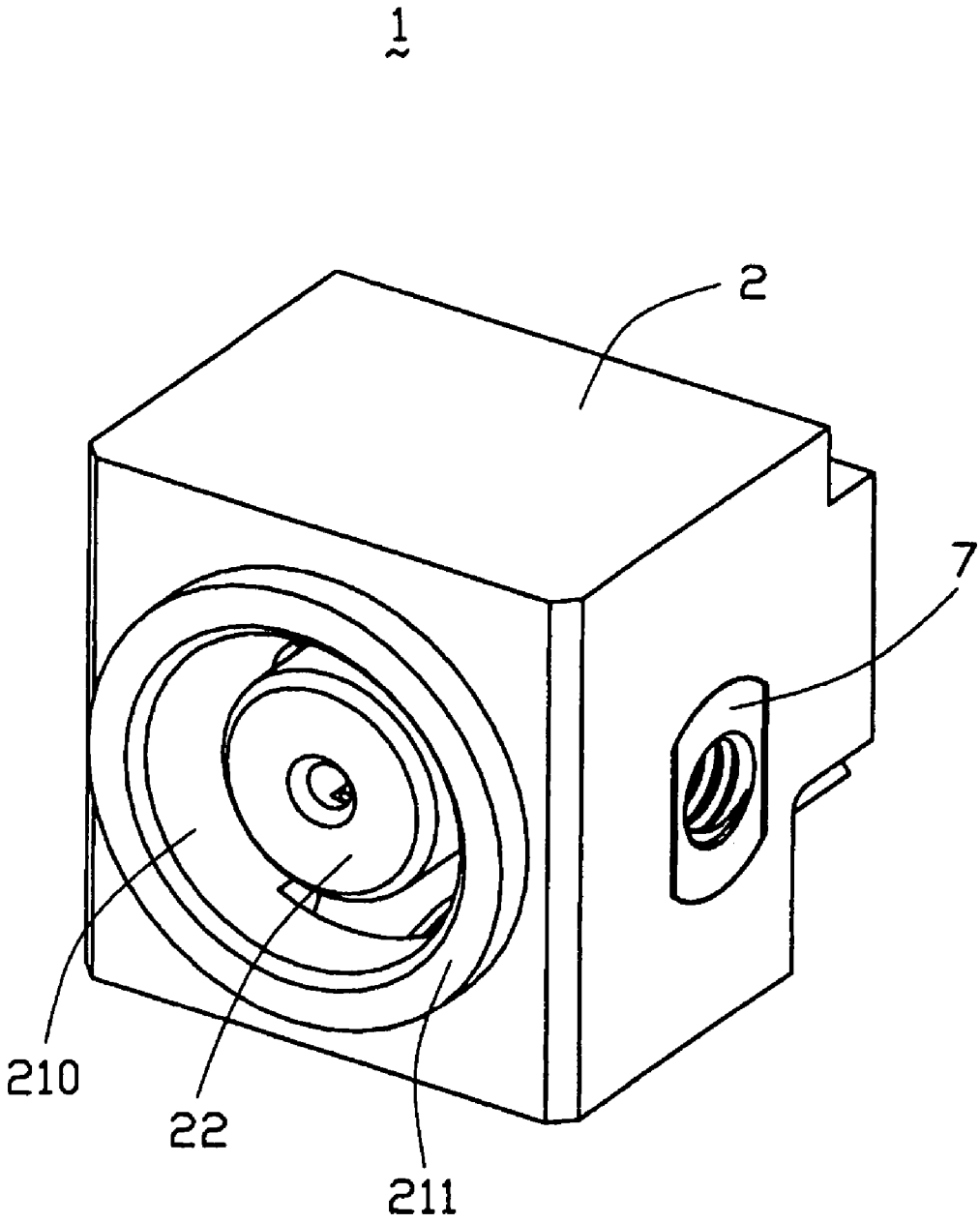
FIG. 4 is an assembled, perspective view of the power connector shown in FIG. 1.

Referring to FIGS. 1-3, a power connector 1 in accordance with the present invention comprises an insulating housing 2, a pair of first and second contacts 3, 4 adapted for power transmission, a third contact 5 used for signal transmission. In the preferred embodiment, the power connector 1 further comprises a biasing member 6, and a screw member 7 lockable to a panel (not shown).

The insulative housing 2 approximately in the shape of a cubical block defines a front face 201 and a pair of side surfaces perpendicular to the front face 201. The housing 2 is formed with a first housing 21 defining a center receiving cavity 210 and a cylindrical second housing 22 protruding into the receiving cavity 210 of the first housing 21. The second housing 22 has a front face (not labeled) flush with the front face 201 and defines a fine receiving groove 220 along a longitudinal axis thereof. A round rim 211 is formed on the front face 201 of the insulative housing 2 along a front fringe of the receiving cavity 210. The housing 2 comprises a first section 212, a second section 213 and a third section 214, which are arranged in turn along a vertical direction of the housing 2. The first section 212 defines a pair of foursquare recesses 2120 at opposite ends thereof, a first rectangular passage 2121 in the center of the first section 212 along a rear-to-front direction, a pair of first channels 2122 recessed laterally from opposite inner surfaces of the first passage 2121, and a pair of first latching openings 2123 in communication with the first channels 2122 and located in a middle of the first section 212. A pair of slits 2124 is defined near bottom surfaces of the corresponding recesses 2120. The second section 213 defines a second passage 2130 in communication with the receiving groove 220 and a pair of semicircular slots 2131 along inner side surfaces of the second passage 2130 for receiving corresponding portion of the complementary connector. The second section 213 further defines a substantially U-shaped third passage 2132 surrounding the second passage 2130 and communicating with the slits 2124 of the first section 212 at opposite upper ends thereof. A second latching opening 2135 (FIG. 5) is defined in bottom surface of the second passage 2130 for fittingly receiving the first contact 3. A pair of rectangular expanding channels 2133 is defined at opposite sides of the second passage 2130 and respectively expands from the pair of vertical portions of the U-shaped third passage 2132. For fittingly receiving the biasing member 6, the third section 214 defines a fourth passage 2140 in the rear-to-front direction, and the second section 213 defines an extending channel (not labeled) communicating with the fourth passage 2140.

Figure 6:
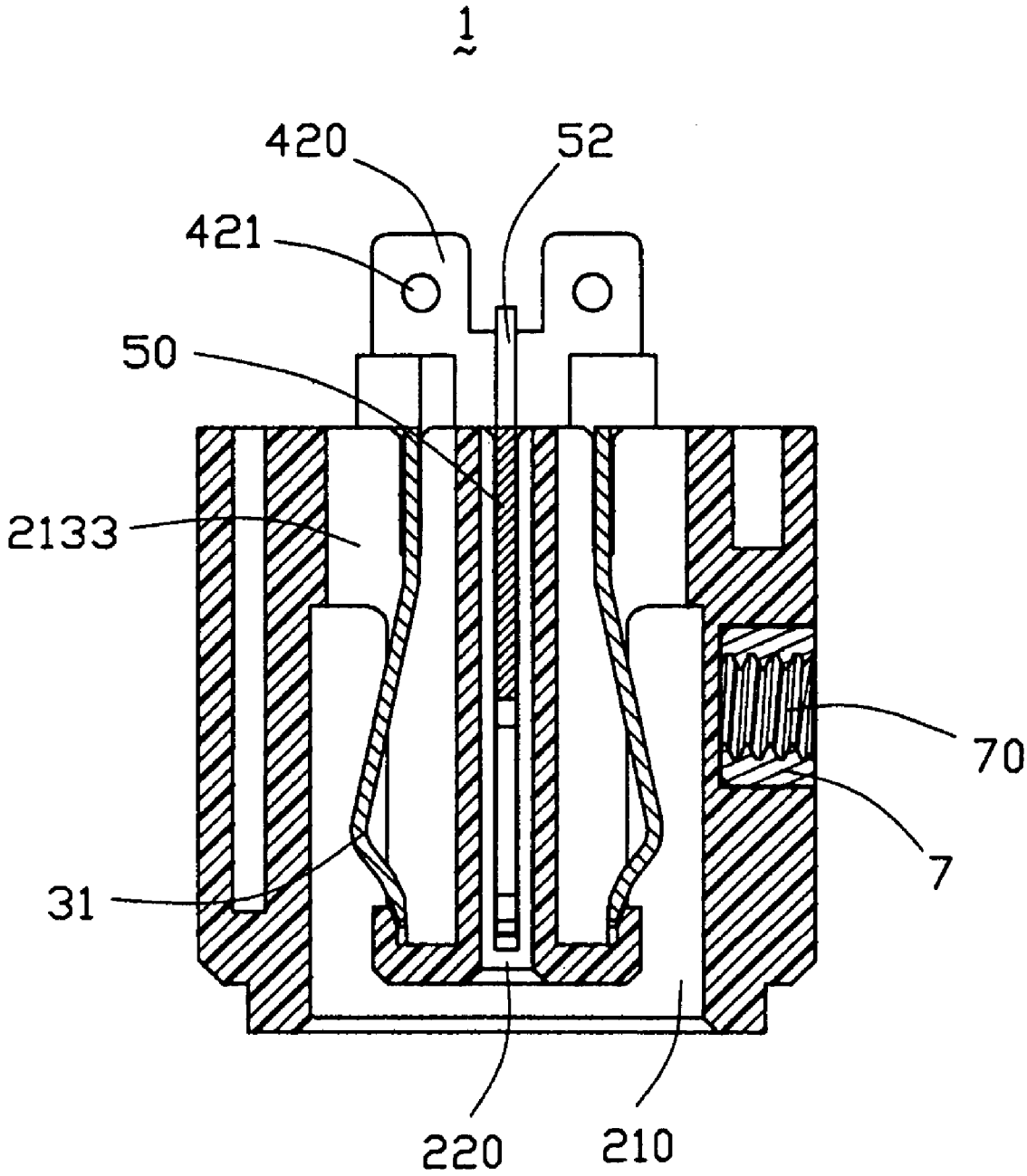
FIG. 6 is a cross-sectional view of FIG. 2 taken along line 6-6.

Referring to FIG. 1 to FIG. 3 and in conjunction with FIG. 6, the first contact 3 is inserted into the third passage 2132 from a rear side of the housing 2 to serve as a positive pole of the power supply. The first contact 3 is formed with an U-shaped main portion 30, a pair of elastic contacting portions 31 laterally and forwardly extending from the main portion 30 and a pair of opposite tail portions 32 laterally extending from opposite bottom ends of the main portion 30. Each of the tail portions 32 defines a retuse U-shaped connecting portion 320 at free end thereof. The main portion 30 forms an upwardly protruding tab 300 snapping into the second latching opening 2135 for positioning purpose. A plurality of bosses 301 is formed on an outer periphery surface of the main portion 30 interferencely engaging with an inner surface of the third passage 2132 for increasing friction force between the first contact 3 and the insulative housing 2. The contacting portion 31 protrudes into the receiving cavity 210 along the expanding channels 2133 so as to elastically contact with corresponding portion of the complementary connector. The tail portions 32 and the main portion 30 are connected by a pair of bending portions (not labeled) respectively received in the corresponding slits 2124 and the U-shape third passage 2132 with the connecting portions 320 respectively located above the bottom surfaces of the recesses 2120.

Figure 5:
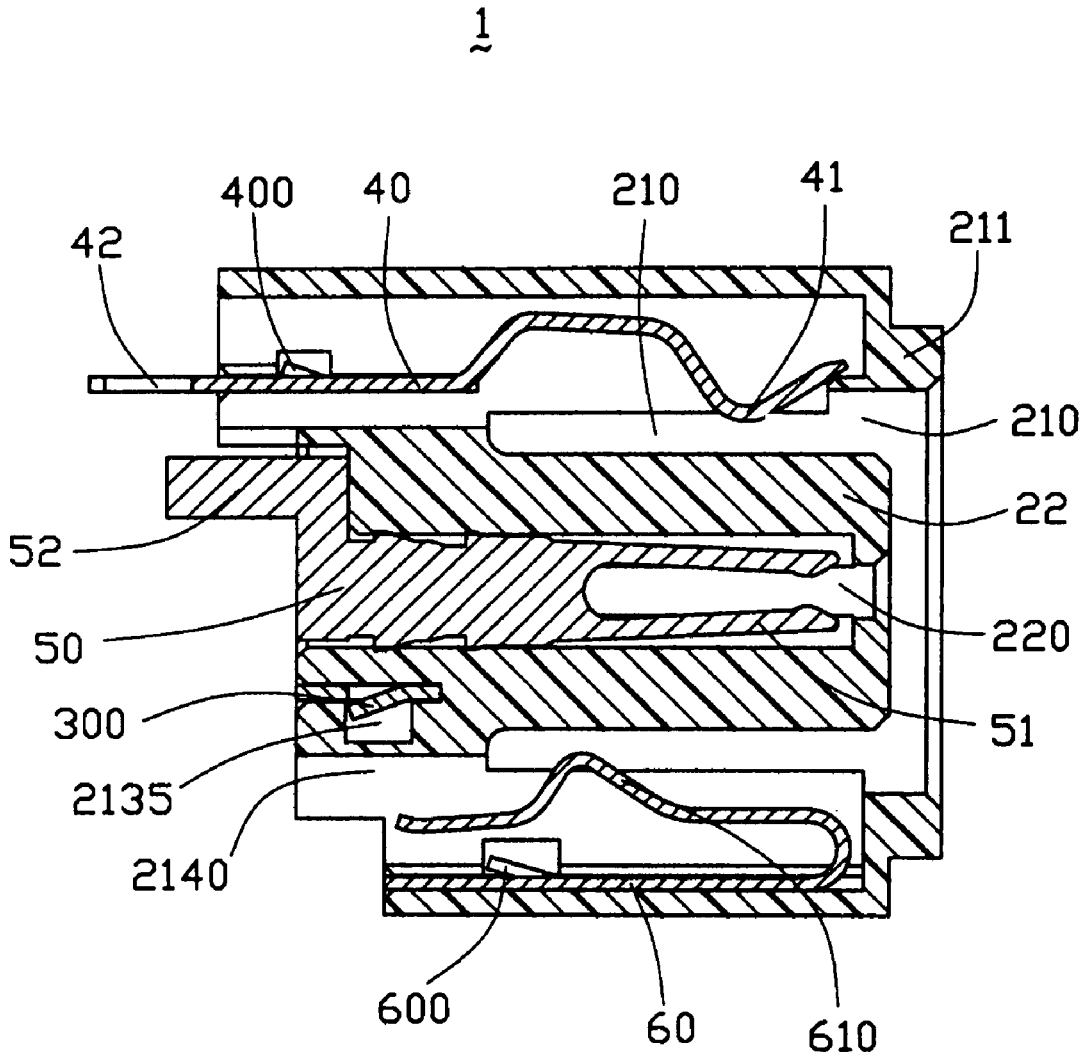
FIG. 5 is a cross-sectional view of FIG. 2 taken along line 5-5.

Referring to FIG. 1 to FIG. 3 and in conjunction with FIG. 5, the second contact 4 is received in the first passage 2121 to serve as a negative pole of the power supply. The second contact 4 comprises a retaining portion 40, a curved elastic contacting portion 41 forwardly extending from the retaining portion 40 and a rearwardly extending tail portion 42. The retaining portion 40 forms a pair of upwardly bending latching tabs 400 at opposite sides thereof for elastically received in the pair of first latching openings 2123 communicating with the first passage 212. The tail portion 42 is formed with two connecting portions 420 spaced apart from each other, each connecting portion 420 defines a through hole 421 in the center thereof for solder material overflowing.

In the present invention, the first and the second contacts 3, 4 each comprises more than one, in the preferred embodiment a pair of, separate connecting portions 320, 420 to respectively solder with corresponding conductors of the cable for transmitting the same type signal, thus, once one of the electrical connection between the connecting portions 320, 420 and the conductors is broken or unsteady, the power supply will not be impacted due to the unspoiled electrical connection between rest connecting portions 320, 420 and the conductors. Therefore, the reliability of the power connector 1 is noticeably increased and thus ensures the running of the electrical device, to which the power connector 1 is connected. It is also acceptable that each tail portion 32, 42 define two spaced connecting areas solderable with the conductors but not separate soldering portion 320, 420 as depicted above. Also can be acceptable is that the connecting portions 320, 420 connect with the conductors of the cable with other means, such as crimping, IDC etc.

Referring to FIGS. 2-6, the third contact 5 is received in the second passage 2130 and comprises a fork-shape mating portion 51 exposed to the receiving groove 220, a securing portion 50 rearwardly extending from the mating portion 51 and a connecting portion 52 upwardly and rearwardly extending from the securing portion 50. The securing portion 50 forms a plurality of barbs (not labeled) at opposite sides thereof interferencely engaging with inner side surface of the second passage 2130, thereby securely retaining the third contact 5 in the housing 2.

The biasing member 6 comprises a flat positioning portion 60 located in a horizontal surface and a rearwardly bent elastic arm 61 approximate parallel to the positioning portion 60. The positioning portion 60 is completely received in the forth passage 2140 of the housing 2, and the elastic arm 61 partially protrudes into the receiving cavity 210 along the extending channel to elastically contact with corresponding portion of the complementary connector so as to increase mating/unmating force exerted to the power connector 1, when the power connector 1 is mated with or withdrawn from the complementary connector.

The secure member 7 in the preferred embodiment with substantially elliptical shape defines a through screw hole 72 in the center thereof. The housing 2 also defines an elliptical receiving recess 215 in one side surface thereof to receive the secure member 7 therein. A plurality of ribs 216 are formed in inner surface of the receiving recess 215 for interferentially engaging with the secure member 7. In application, the power connector 1 is secured to the panel by engagement of the secure member 7 and a screw (not shown). That is, the power connector 1 is secured to the panel in a direction perpendicular to the mating direction thereof. In addition, the secure member 7 is received in the first housing 21 with outer surface thereof flush with one side surface of the first housing 21. The secure member 7 also could be configured in other shapes and assembled to the panel by other ways. Besides, since the first and second contacts 3, 4 are used for power transmission in the preferred embodiment, the first and second contacts 3, 4 respectively define two separate connecting portions or connecting areas to increase stability of the power transmission system. However, in some specific application, the third contact 5 also could define two soldering portions or soldering areas to ensure signal transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector matable with a complementary connector for power transmission, comprising:

an insulative housing defining a receiving cavity;

a cable comprising a plurality of conductors;

at least one contact capable of power transmission, the at least one contact received in the housing and comprising a contacting portion exposed to the receiving cavity and a tail portion extending beyond the housing; and the tail portion composed of more than one connecting portions, the connecting portions of the tail portion electrically connecting with corresponding conductors of the cable to transmitting the same type power; the at least one contact comprising first and second contacts capable of power transmission; and a third contact used for signal transmission; and wherein the first contact, the second contact and the third contact are respectively arranged n the insulative housing along a vertical direction.

2. The power connector as claimed in claim 1, wherein the first and second contacts respectively comprises a tail portion defining two separate connecting portions for transmitting the same type signal.

3. The power connector as claimed in claim 2, wherein the first contact is served as a positive pole of the power connector and comprises a U-shaped main portion retained in the housing, a pair of elastic contacting portions forwardly extending from the main portion and exposed in the receiving cavity, and a pair of connecting portions at free end thereof.

4. The power connector as claimed in claim 3, wherein the second contact is served as a negative pole of the power connector and comprises a retaining portion retained to the housing, a contacting portion forwardly extending from the retaining portion into the receiving cavity of the housing and a pair of spaced connecting portions rearwardly extending from the retaining portion.

5. The power connector as claimed in claim 3, wherein the soldering portions of the second contact respectively define a through hole in the center thereof.

6. The power connector as claimed in claim 1, wherein the third contact comprises a fork-shape mating portion and an opposite connecting portion extending beyond the housing.

7. The power connector as claimed in claim 1, wherein the second contact locates in a substantially horizontal extending surface, and wherein the third contact locates in a vertical extending surface.

8. The power connector as claimed in claim 1, wherein the power connector comprises a biasing member assembled to the housing elastically contacting with corresponding portion the complementary connector.

9. The power connector as claimed in claim 1, wherein the power connector comprises a secure member assembled to the housing for securing the power connector to a panel.

10. The power connector as claimed in claim 9, wherein the secure member is assembled to the insulative housing in a direction perpendicular to the mating direction of the power connector.

11. The power connector as claimed in claim 9, wherein the secure member is secured with the panel in a direction perpendicular to the mating direction of the power connector.

12. An electrical connector comprising:

a cable having a plurality of conductors;

an insulative housing defining at least one passage;

at least one unitary contact assembled to the insulative housing and received in the at least one passage;

the at least one unitary contact comprising at least one contacting portion adapted for electrically connecting with a complementary connector, two connecting portions spaced from each other and each electrically connecting with a corresponding conductor of the cable, wherein both said two connecting portions constantly transmit a same type signal.

13. An electrical connector, comprising:

a cable having a plurality of conductors;

an insulative housing defining at least one passage;

at least one contact assembled to the insulative housing and received in the at least one passage;

the at least one contact comprising at least one contacting portion adapted for electrically connecting with a complementary connector, more than one connecting portions each electrically connecting with a corresponding conductor of the cable, and single retaining portion connecting the at least one contacting portion with the more than one connecting portions, and wherein the more than one connecting portions transmits the same type signal for the electrical connector for achieving reliable signal transmission, wherein transmission of said same type signal of both said two connecting portions is performed constantly.

* * * * *